US005758786A

United States Patent [19]

John

[11] Patent Number: 5,758,786

[45] Date of Patent: Jun. 2, 1998

[54] MULTI-COMPARTMENT BABY BOTTLE

[76] Inventor: Nigel H. John, 115-46 209th St., New York, N.Y. 11411

[21] Appl. No.: 745,720

[22] Filed: Nov. 12, 1996

[51] Int. Cl.[6] ..... A61J 9/00; A61J 11/04

[52] U.S. Cl. ..... 215/6; 215/11.1; 215/11.4; 222/142.9

[58] Field of Search ..... 215/11.1, 11.4, 215/6; 222/142.9

[56] References Cited

U.S. PATENT DOCUMENTS

| | | | |
|---|---|---|---|
| 2,372,281 | 3/1945 | Jordan | 215/11.1 |
| 3,211,315 | 10/1965 | Griesinger | 215/11.1 |
| 5,060,811 | 10/1991 | Fox | 215/11.4 X |
| 5,593,052 | 1/1997 | McGee | 215/11.4 X |

*Primary Examiner*—Sue A. Weaver

[57] ABSTRACT

A container is divided into multiple compartments by a series of vertically extending partitions radiating from the central axis of the container. A nipple is attached to a collar which in turn, is attachable to the mouth of the container. The nipple includes a base portion having an aperture radially offset from the central axis of the nipple and which is adapted to register with only one of the compartments depending upon the relative angular orientation of the nipple and the collar. A series of L-shaped slots is provided on the collar with the slots being evenly spaced about the periphery of the collar and with the number thereof corresponding to the number of internal compartments in the container. The inside surface of the nipple sidewall carries a like number of projections evenly spaced about the inside periphery thereof and adapted to engage corresponding L-shaped slots on the collar. To change the angular orientation of the nipple and collar, the nipple is counter-rotated to unlock and disengage the projections from the slots. The nipple may then be rotated to a new relative angular position relative to the collar, and locked relative to the collar by causing the projections to engage the slots in the new orientation. Each time the relative angular orientation of the nipple is changed relative to the collar, the aperture in the base portion registers with a different vertical compartment thereby allowing the fluid only in that compartment to be discharged through the nipple.

5 Claims, 2 Drawing Sheets

FIG 3
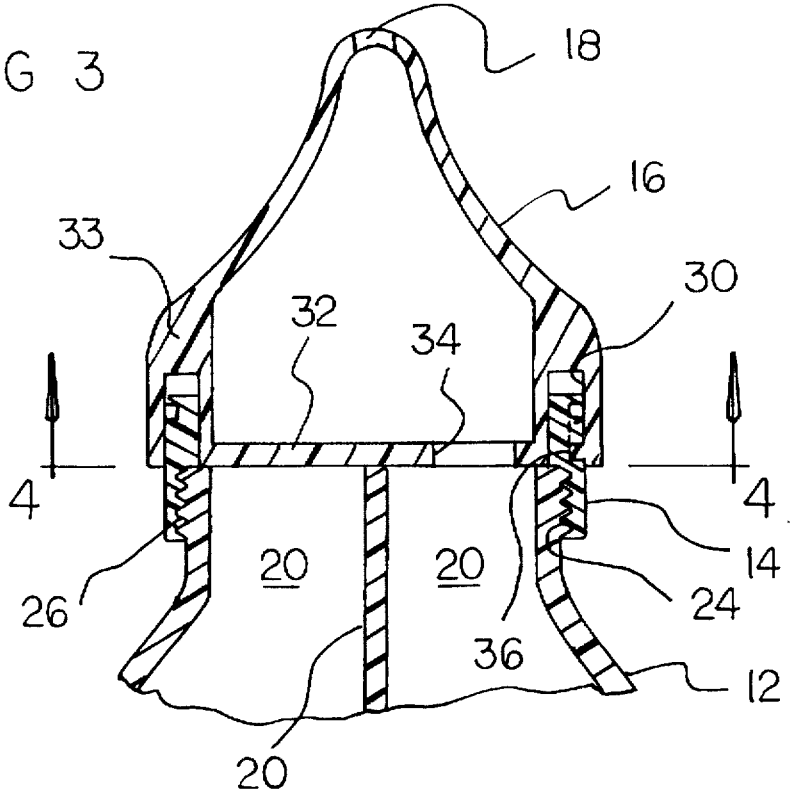
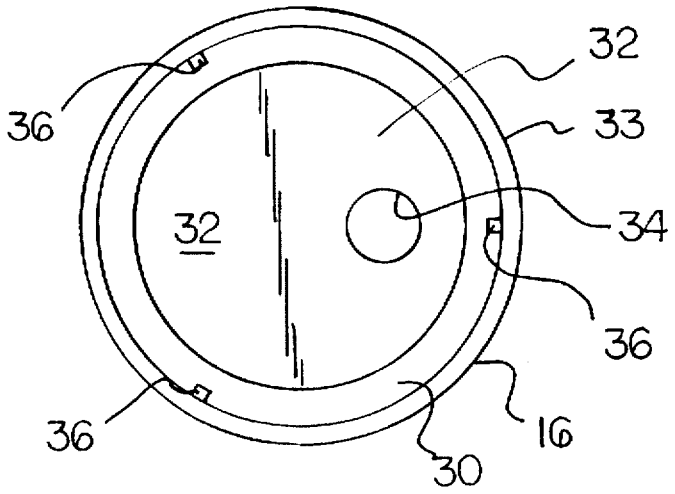
FIG 4

MULTI-COMPARTMENT BABY BOTTLE

RELATED APPLICATION

This application claims priority based upon my co-pending prior provisional application Ser. No. 60/006,631; filed Nov. 13, 1995.

1. Field of the Invention

The present invention relates generally to containers for pourable substances (e.g. fluids) and more particularly, to containers useful as a so called "baby bottle" having multiple compartments each of which is selectively positionable to communicate with the same "nipple."

2. Description of the Prior Art

Conventional "baby bottles" are known comprising a nipple, a container, and a cap for affixing the nipple to the container. The container invariably has a single chamber so that only a single type of pourable substance may be used therein, e.g. milk. It would be extremely desirable however, if the container could be provided with a multiple of compartments the contents of which are discharged through the same nipple. In this way, milk could be stored in one compartment, juice in another, and say, water in a third. It would not be necessary to carry three separate containers for each different type pourable substance as they could all be selectably administered in a convenient unitary device. Such an advantageous arrangement in the form of a multiple-compartment baby bottle is contemplated by the present invention.

In at least the foregoing respects, the apparatus according to the present invention is believed to substantially depart from the conventional concepts and designs of the prior art, and in so doing provides an important contribution to the art of portable containers in general, and to the art of "baby bottles" having multiple compartments each of which is selectively positionable with a single nipple assembly, in particular.

SUMMARY OF THE INVENTION

Briefly described, the present invention relates to a container having a hollow interior is divided into multiple compartments by a series of vertically extending partitions radiating from the central axis of the container. Each compartment is adapted to be filled with a liquid of differing character, e.g. milk, fruit juice, water or the like. A nipple is attached to a collar which in turn, is attachable to the mouth of the container. The nipple includes a base portion having an aperture radially offset from the central axis of the nipple and which is adapted to register with only one of the compartments depending upon the relative angular orientation of the nipple and the collar. A series of L-shaped slots is provided on the collar with the slots being evenly spaced about the periphery of the collar and with the number thereof corresponding to the number of internal compartments in the container. The inside surface of the nipple sidewall carries a like number of projections evenly spaced about the inside periphery thereof and adapted to engage corresponding L-shaped slots on the collar. By twisting the nipple relative to the collar after the slots are engaged by the projections, the nipple and collar will be locked together. To change the angular orientation of the nipple and collar, the nipple is counter-rotated to unlock and disengage the projections from the slots. The nipple may then be rotated to a new relative angular position relative to the collar, and locked relative to the collar by causing the projections to engage the slots in the new orientation. Each time the relative angular orientation of the nipple is changed relative to the collar, the aperture in the base portion registers with a different vertical compartment thereby allowing the fluid only in that compartment to be discharged through the nipple.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multiple compartment container apparatus which has all of the advantages of the prior art and none of the disadvantages.

Another object of the present invention is to provide a multiple compartment container apparatus that is easy to fabricate, relatively inexpensive to produce and purchase, easy to maintain and simple to use.

Still another object of the present invention is to provide a new and improved multiple compartment container for a pourable substance.

It is another object of the present invention to provide a new and improved multiple compartment container especially useful as a baby bottle.

It is a further object of the invention to provide a new and improved multiple compartment container especially useful as a baby bottle and which includes a nipple and cap assembly having means for selectably assuring discharge of pourable contents from any one of the compartments.

These together with other objects of the invention, along with the various features of novelty and construction which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional elevational view of the assembled invention taken along line 3—3 of FIG. 1.

FIG. 4 is a plan view of the bottom of the nipple according to the present invention.

DESCRIPTION OF THE PREFERRED EMBODIMENTS

Figure 1:
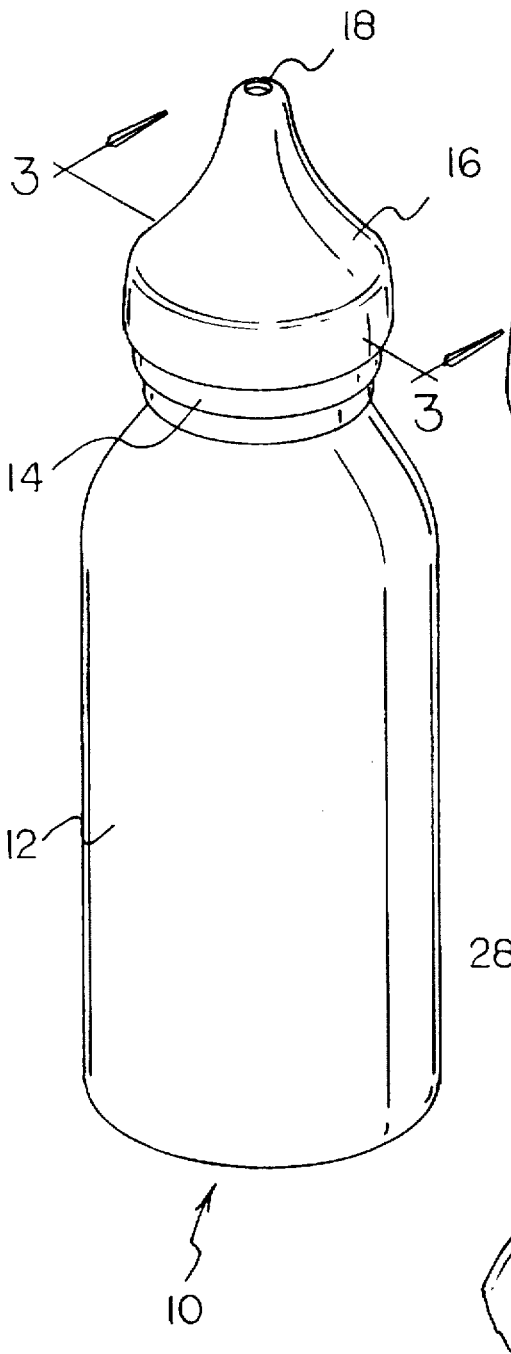
FIG. 1 is an isometric view of my invention for a multi-compartment baby bottle.

With reference now to the annexed drawings, and in particular to FIGS. 1–4 thereof, a new multi-compartmented baby bottle embodying the principles and concepts of the present invention and generally designated by the reference numeral 10 will be described.

Figure 2:
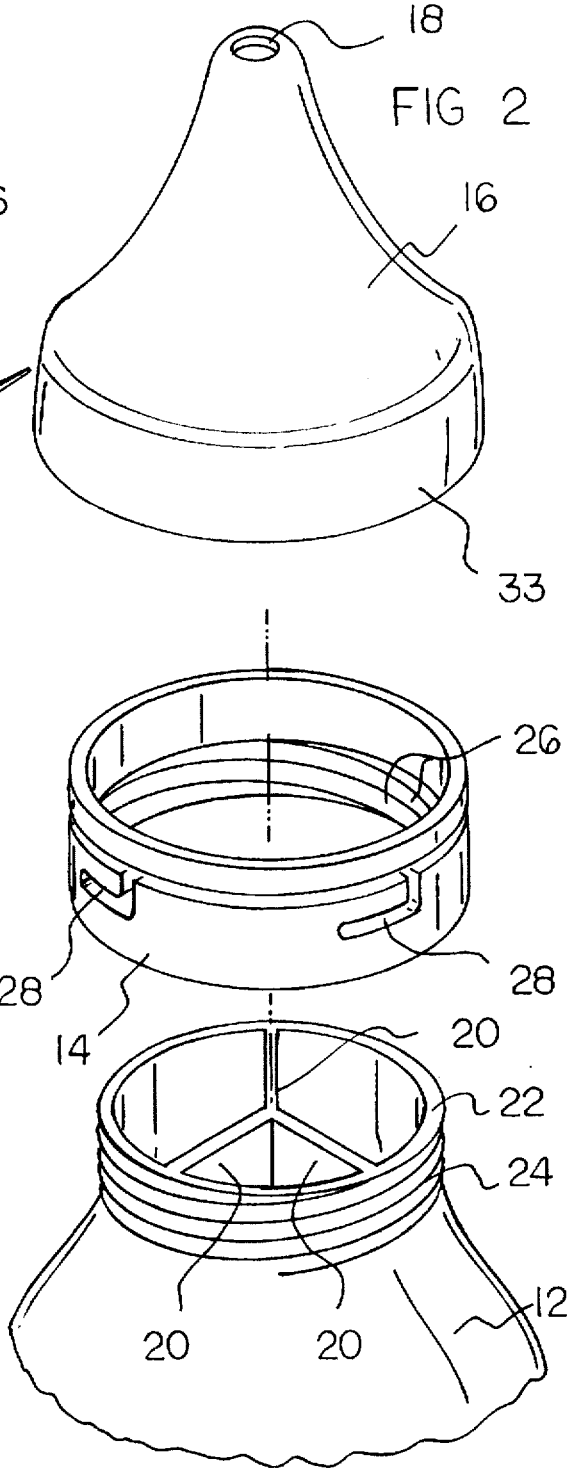
FIG. 2 is an exploded isometric illustration of the nipple, the collar, and the top portion of the container of the invention shown in FIG. 1 shown in enlarged scale.

FIG. 1 shows the assembled baby bottle 10 comprising the container 12, the fastening collar 14, and the nipple 16 having a suitable opening 18 for discharging a liquid therethrough. As shown in FIG. 2, a series of three radially oriented partitions is provided to divide the hollow interior into three generally vertically extending compartments. The top edges of partitions 20 coincide with each other and top edge 22 of the neck of the container 12 substantially as shown. The external surface of the neck of the container immediately below the top edge 22 is screw threaded at 24 to form a threaded fastener surface engagable with the inside complimentarily threaded surface 26 of collar 14 (FIG. 3). Collar 14 has a radially enlarged outer lower section into which are formed evenly peripherally spaced L-shaped slots 28 substantially as shown in FIG. 2. The sidewall 33 of nipple 16 is provided with a circumferential channel 30 surrounding horizontal base or floor portion 32 through which eccentrically located opening 34 extends to provide a flow passage communicating a particular selected compartment in container 12 with opening 18 in nipple 16.

FIG. 4 shows a series of evenly circumferentially spaced protuberances 36 projecting orthogonally into channel 30 substantially as shown with the protuberances or projections 36 being sufficiently sized to lockingly engage the corresponding spaced slots 28 upon angular rotational movement of the nipple relative to the collar. Such twist lock engagement results in the relationship of parts shown in FIG. 4. In the position of the parts as shown in FIG. 4, the bottom surface of base portion effectively seals off the compartments of container 12 relative to nipple opening 18 not in registration with opening 34.

In order to change an existing registration of opening 34 with a particular compartment in container 12, all that is necessary is to unlock the nipple from the collar utilizing a "twist and lift" motion, rotate the nipple to a new angular position relative to the collar, and "twist lock" the nipple relative to the collar in a selected new position by causing the projections to engage the slots in the new orientation—whereby opening 34 will be in registration with a new and different compartment of container 12. Thus, each time the relative angular orientation of the nipple is changed relative to the collar, the eccentric aperture 34 in the base portion registers with a different corresponding vertical compartment thereby allowing only fluid in that compartment to be discharged through the nipple.

The constituent parts of the multi-compartmented baby bottle according to the present invention may preferably be fabricated from known durable and heat-resistant synthetic polymeric materials.

As to the manner of usage and operation of the instant invention, the same is apparent from the above disclosure, and accordingly, no further discussion relative to the manner of usage and operation need be provided.

The foregoing detailed description is considered as illustrative only of the principles of the invention. Numerous modifications and changes will readily occur to those skilled in the art and therefore, it is not desired to limit the invention to the exact construction and operation shown and described. Accordingly, all suitable modifications and equivalents may be resorted to, falling within the scope of the invention as defined only in the appended claims.

What is claimed as being new and desired to be protected by Letters Patent of the United States is as follows:

1. Container apparatus, comprising:

an enclosure for storing a pourable substance, said enclosure having a bottom, a sidewall and a top edge on said sidewall defining a first opening through which said pourable substance may be placed in said container, a removable cap assembly on said top edge, said removable cap assembly including discharge means defining a second opening through which said pourable substance may be discharged from said container, and selectively adjustable flow control means interposed between said discharge means and said first opening for controlling the flow of said pourable substance through both said first and second openings, wherein said container further includes an interior partition for dividing the interior of said container into separate enclosable sections, and said selectively adjustable flow control means includes means defining a passage between one of said enclosable sections and said second opening and further includes means for preventing a passage between any other enclosable section and said second opening, wherein said partition has a top edge and said selectively adjustable flow control means comprises a movable flow control member transversely extending relative to said opening, said movable flow control member engaging said top edge of said partition, said movable flow control member further including an aperture therethrough wherein in first position of said movable flow control member said aperture provides a flow passage between one of said enclosable sections and said second opening and wherein in a second position of said movable flow control member said aperture provides a flow passage between another of said enclosable sections and said second opening, wherein said cap assembly comprises a nipple, said second opening being in said nipple, said nipple being located on an annular support member adapted to be attached to said container top edge, and wherein said movable flow control member includes a transverse floor member carried by said annular support member, said aperture being located in said floor, wherein said aperture is located in said transverse floor member in an offset manner whereby rotation of said annular support member about an axis passing commonly through said floor member and said container is effective to rotate said aperture about said common axis, wherein said cap assembly includes a locking ring disposed between said annular support member and said top edge of said container, said locking ring including fastening means for removably affixing said locking ring to said container, said annular support member including means for removably affixing said annular support member to said locking ring in a plurality of different selectable positions with respect to said common axis, wherein said locking ring includes a plurality of equally spaced engagement means and said annular support member includes a plurality of complimentary engagement means matable with said plurality of equally spaced engagement means on said locking ring in different selectable positions of said annular support member relative to said locking ring with respect to said common axis, and wherein said engagement means on said locking ring includes a plurality of L-shaped slots in said locking ring and the said complimentary matable engagement means on said annular support member includes a plurality of protrusions adapted to be received in said L-shaped slots and locked therein when said annular support member is selectably twisted about said locking ring relative to said common axis.

2. The apparatus of claim 1 wherein said partition is a first partition dividing said container into first and second enclosable sections.

3. The apparatus of claim 2 further including a second partition for dividing said first and second enclosable sections into first, second and third enclosable sections.

4. The apparatus of claim 1 wherein said partition divides said container into first and second enclosable sections, and wherein in said first position of said movable flow control member said aperture provides a flow passage between said first enclosable sections and said second opening and wherein in a second position of said movable flow control member said aperture provides a flow passage between said second enclosable section and said second opening.

5. The apparatus of claim 1 wherein said partition is a first partition and said apparatus further includes a second partition for dividing said container into first, second and third enclosable sections, and said wherein in said first position of said movable flow control member said aperture provides a flow passage between said first enclosable sections and said second opening and wherein in a second position of said movable flow control member said aperture provides a flow passage between either said second enclosable section or said third enclosable section and said second opening.

* * * * *